US010319319B2

(12) United States Patent
Cao

(10) Patent No.: US 10,319,319 B2
(45) Date of Patent: Jun. 11, 2019

(54) SUBSTRATES AND LIQUID CRYSTAL DISPLAYS

(71) Applicant: Shenzhen China Star Optoelectronics Technology Co., Ltd., Shenzhen, Guangdong (CN)

(72) Inventor: Shangcao Cao, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 4 days.

(21) Appl. No.: 14/769,781

(22) PCT Filed: Jul. 22, 2015

(86) PCT No.: PCT/CN2015/084764

§ 371 (c)(1),
(2) Date: Aug. 21, 2015

(87) PCT Pub. No.: WO2016/176914

PCT Pub. Date: Nov. 10, 2016

(65) Prior Publication Data

US 2016/0327819 A1 Nov. 10, 2016

(30) Foreign Application Priority Data

May 7, 2015 (CN) ..... 2015 1 02298471

(51) Int. Cl.
*G09G 3/36* (2006.01)

(52) U.S. Cl.
CPC ..... *G09G 3/3648* (2013.01); *G09G 3/3659* (2013.01); *G09G 2300/0447* (2013.01);
(Continued)

(58) Field of Classification Search
None
See application file for complete search history.

(56) References Cited

U.S. PATENT DOCUMENTS 5,151,689 A 9/1992 Kabuto et al.
7,567,228 B1 * 7/2009 Wen ..... G09G 3/3614 345/204

(Continued)

FOREIGN PATENT DOCUMENTS

CN 101826300 A 9/2010
CN 102116979 A 7/2011

*Primary Examiner* — Amr A Awad
*Assistant Examiner* — Andre L Matthews
(74) *Attorney, Agent, or Firm* — Andrew C. Cheng

(57) ABSTRACT

The present disclosure relates to a substrate and a liquid crystal display. The substrate includes a plurality of data lines, scanning lines, and pixel cells arranged in a matrix. Each of the pixel cells includes a first sub-pixel and a second sub-pixel. For the pixel cells in each row, a first sub-pixel of a pixel cell connects with the two scanning lines. The second sub-pixel of the pixel cell connects with one of the scanning line. When the pixel cells are driven, durations of the turn-on signals outputted by the two scanning lines connected with the pixel cell are different or the turn-on signals are asynchronous. As such, a turn-on period of the second sub-pixel of the pixel cell connecting with the data line is longer than the turn-on period of the first sub-pixel connecting with the corresponding data line. In this way, the color shift may be reduced.

19 Claims, 4 Drawing Sheets

(52) U.S. Cl.
CPC ..... *G09G 2300/0814* (2013.01); *G09G 2310/0205* (2013.01)

(56) References Cited

U.S. PATENT DOCUMENTS

| | | | | |
|---|---|---|---|---|
| 8,605,126 | B2 * | 12/2013 | Kang | G09G 3/3614 345/55 |
| 2012/0206437 | A1 | 8/2012 | Kang et al. | |
| 2014/0049619 | A1 * | 2/2014 | Hsieh | G02F 1/136286 348/51 |
| 2014/0054624 | A1 * | 2/2014 | Chen | G09G 3/32 257/89 |
| 2015/0220294 | A1 | 8/2015 | Zheng et al. | |
| 2016/0247822 | A1 | 8/2016 | Chen et al. | |
| 2016/0275888 | A1 | 9/2016 | Chen et al. | |

* cited by examiner

SUBSTRATES AND LIQUID CRYSTAL DISPLAYS

BACKGROUND OF THE INVENTION

1. Field of the Invention

The present disclosure relates to liquid crystal display technology, and more particularly to a substrate and a liquid crystal display (LCD) thereof.

2. Discussion of the Related Art

LCDs have been widely adopted in a variety of electronic devices, such as computers or televisions. Especially, vertical alignment (VA) LCDs are very popular due to attributes including high contrastness and low difficulties of manufacturing process.

However, the display of the LCDs may be restricted by viewing angle. For instance, contrastness may be quite different when viewing from different angles for the VA LCDs, which results in color shift.

SUMMARY

According to the present disclosure, the substrate and the LCDs are capable of reducing the color shift.

In one aspect, a substrate includes: a plurality of data lines, scanning lines, pixel cells arranged in a matrix, each of the pixel cells including a first sub-pixel and a second sub-pixel, wherein the pixel cells located in every two adjacent columns constituting a pixel cell set, each of the data lines connecting to one pixel cell set for providing voltage signals to the pixel cell set; for the pixel cells in each row, a first sub-pixel of a first pixel cell of the pixel cell set connecting with the two scanning lines including a first scanning line and a second scanning line, the first scanning line and the second scanning line being arranged at two lateral sides of the first sub-pixel or being arranged at the same side of the first sub-pixel, the second sub-pixel of the first pixel cell connecting with the first scanning line connected with the first sub-pixel of the first pixel cell; the first sub-pixel of the second pixel cell of the pixel cell set connecting with the second scanning line connected with the first pixel cell located in the same row, connecting with the first scanning line connected with the first pixel cell in the adjacent next row, and the second sub-pixel of the second pixel cell connecting with the second scanning line connected with the first pixel cell in the same row; the scanning line outputting turn-on signals for connecting the sub-pixels connected with the scanning line to the corresponding data line; when the pixel cells being driven, durations of the turn-on signals outputted by the two scanning lines connected with the pixel cell being different or the turn-on signals being asynchronous such that a turn-on period of the second sub-pixel of the pixel cell connecting with the data line being longer than the turn-on period of the first sub-pixel connecting with the corresponding data line; and the second sub-pixel connecting to the corresponding data line via a transistor, a control end of the transistor connecting with the scanning line corresponding to the second sub-pixel, the first sub-pixel connecting with the corresponding data line via two transistors, the control ends of the two transistors respectively connecting with the two scanning lines corresponding to the first sub-pixel.

Wherein the first pixel cell is the pixel cell in the odd column, and the second pixel cell is the pixel cell in the even column; or the second pixel cell is the pixel cell in the odd column, and the first pixel cell is the pixel cell in the even column.

Wherein the first pixel cell comprises the pixel cell in the odd row and in the odd column and the pixel cell in the even row and in the even column, and the second pixel cell comprises the pixel cell in the odd row and in the even column and the pixel cell in the even row and in the odd column; or the second pixel cell comprises the pixel cell in the odd row and in the odd column and the pixel cell in the even row and in the even column, and the first pixel cell comprises the pixel cell in the odd row and in the even column and the pixel cell in the even row and in the odd column.

Wherein the first pixel cell comprises the pixel cells located in one odd column and one even column of the two adjacent pixel cell set, and the second pixel cell comprises the pixel cells located in the other odd column and the other even column of the two adjacent pixel cell set.

Wherein the turn-on signals of the scanning lines comprises a first turn-on signals and a second turn-on signals, a duration of the first turn-on signals is shorter than the duration of the second turn-on signals, and a start time of the first turn-on signals is at least within the duration of the second turn-on signals of the scanning line of a previous row.

Wherein the durations of the turn-on signals of each of the scanning lines are the same, and a start time of the turn-on signals of the previous row is earlier than the start time of the turn-on signals of the next row, and an end time of the turn-on signals of the previous row is later than the start time of the turn-on signals of the next row.

In another aspect, a substrate, includes: a plurality of data lines, scanning lines, pixel cells arranged in a matrix, each of the pixel cells including a first sub-pixel and a second sub-pixel, wherein the pixel cells located in every two adjacent columns constituting a pixel cell set, each of the data lines connecting to one pixel cell set for providing voltage signals to the pixel cell set; for each of the pixel cells, a first sub-pixel of a first pixel cell of the pixel cell set connects with the two scanning lines, the second sub-pixel of the first pixel cell connecting with one of the scanning line; the first sub-pixel of the second pixel cell of the pixel cell set connecting with one of the scanning lines connected with the first pixel cell in the same row, and connecting with one scanning line connected with the first pixel cell in the adjacent next row, and the second sub-pixel of the second pixel cell connecting with one of the scanning line connected with the first sub-pixel of the second pixel cell; the scanning line outputting turn-on signals for connecting the sub-pixels connected with the scanning line to the corresponding data line; when the pixel cells being driven, durations of the turn-on signals outputted by the two scanning lines connected with the pixel cell being different or the turn-on signals being asynchronous such that a turn-on period of the second sub-pixel of the pixel cell connecting with the data line being longer than the turn-on period of the first sub-pixel connecting with the corresponding data line.

Wherein the first pixel cell is the pixel cell in the odd column, and the second pixel cell is the pixel cell in the even column; or the second pixel cell is the pixel cell in the odd column, and the first pixel cell is the pixel cell in the even column.

Wherein the first pixel cell comprises the pixel cell in the odd row and in the odd column and the pixel cell in the even row and in the even column, and the second pixel cell comprises the pixel cell in the odd row and in the even column and the pixel cell in the even row and in the odd column; or the second pixel cell comprises the pixel cell in the odd row and in the odd column and the pixel cell in the even row and in the even column, and the first pixel cell comprises the pixel cell in the odd row and in the even column and the pixel cell in the even row and in the odd column.

Wherein the first pixel cell comprises the pixel cells located in one odd column and one even column of the two adjacent pixel cell sets, and the second pixel cell comprises the pixel cells located in the other odd column and the other even column of the two adjacent pixel cell sets.

Wherein for the pixel cells in each row, the two scanning lines including a first scanning line and a second scanning line, the first scanning line and the second scanning line being arranged at two lateral sides of the first sub-pixel or being arranged at the same side of the first sub-pixel; and wherein the second sub-pixel of the first pixel cell connects with the first scanning line connected with the first sub-pixel of the first pixel cell; and the first sub-pixel of the second pixel cell connects to the second scanning line connected with the first pixel cell in the same row, and connects to the first scanning line connected with the first pixel cell in the adjacent next row, and the second sub-pixel of the second pixel cell connects to the second scanning line connected with the first pixel cell in the same row.

Wherein the turn-on signals of the scanning lines comprises a first turn-on signals and a second turn-on signals, a duration of the first turn-on signals is shorter than the duration of the second turn-on signals, and a start time of the first turn-on signals is at least within the duration of the second turn-on signals of the scanning line of a previous row.

Wherein the durations of the turn-on signals of each of the scanning lines are the same, and a start time of the turn-on signals of the previous row is earlier than the start time of the turn-on signals of the next row, and an end time of the turn-on signals of the previous row is later than the start time of the turn-on signals of the next row.

Wherein the three adjacent pixel cells in the same row are respectively red, green, and blue pixel cells.

Wherein the second sub-pixel connects to the corresponding data line via a transistor, a control end of the transistor connects with the scanning line corresponding to the second sub-pixel, the first sub-pixel connects with the corresponding data line via two transistors, the control ends of the two transistors respectively connects with the two scanning lines corresponding to the first sub-pixel.

In one aspect, a liquid crystal display includes a first substrate, a second substrate opposite to the first substrate, and liquid crystals between the first substrate and the second substrate. The first substrate may be the above-mentioned substrate.

In view of the above, the pixel cell of the substrate includes a first sub-pixel and a second sub-pixel. The first sub-pixel connects to two scanning lines, and the second sub-pixel connects to one of the scanning lines connected with the first sub-pixel. When the pixel cells are driven, the durations of the turn-on signals of the second sub-pixel with respect to the corresponding data line is longer than that of the first sub-pixel. As such, the turn-on period of the second sub-pixel of the pixel cell corresponding to the data line is longer than that of the first sub-pixel. That is, the charging duration of the first sub-pixel is different from that of the second sub-pixel, which results in that different voltages are adopted to drive the liquid crystals corresponding to the first and the second sub-pixel. In this way, the alignment of the liquid crystals are different so as to reduce the color shift. In addition, every two pixel cells located in adjacent columns may share one data line, which reduces the number of the data lines so as to guarantee the aperture rate and the cost.

DETAILED DESCRIPTION OF THE EMBODIMENTS

Embodiments of the invention will now be described more fully hereinafter with reference to the accompanying drawings, in which embodiments of the invention are shown.

Figure 1:
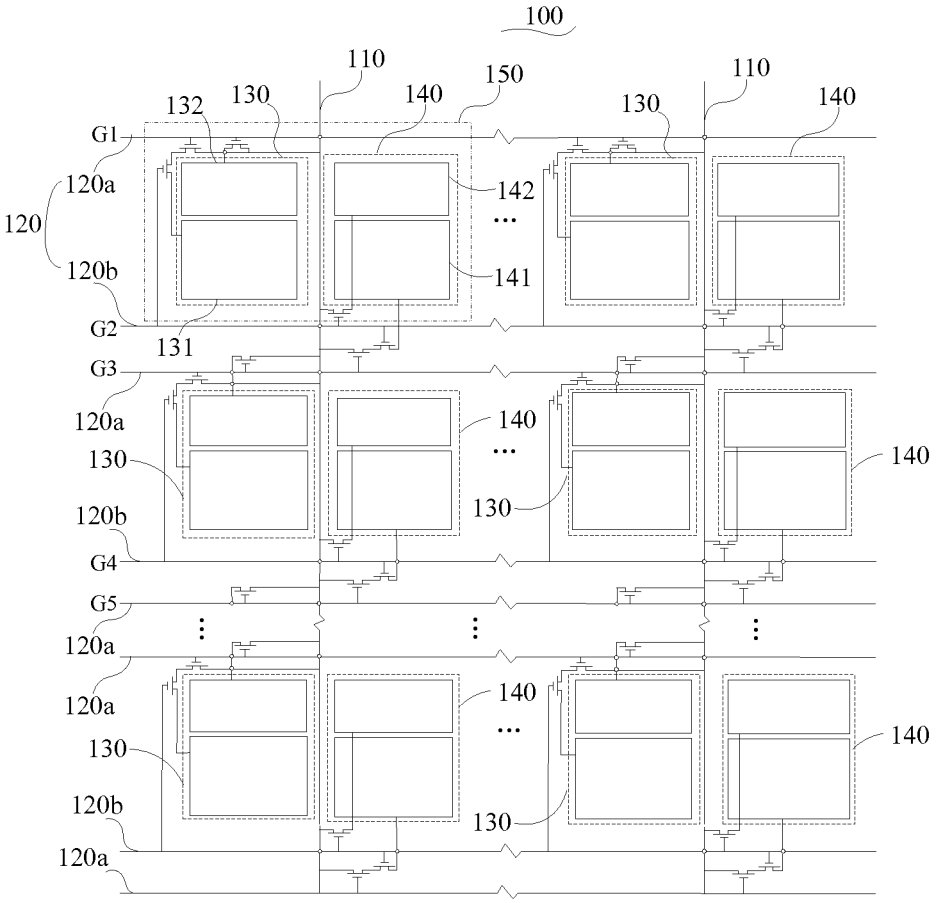
FIG. 1 is schematic view of the substrate in accordance with one embodiment.
Figure 2:
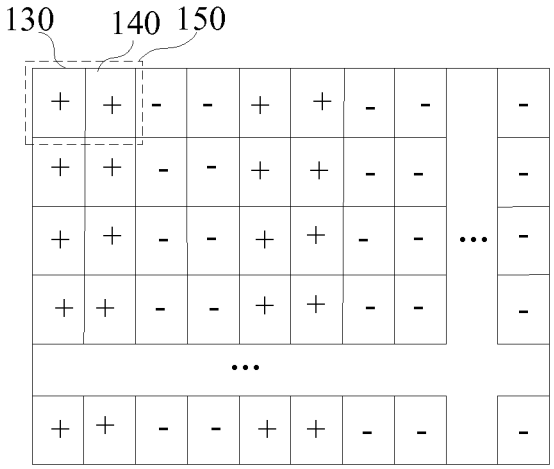
FIG. 2 is a schematic view showing the polarity of the driving voltage of the substrate of FIG.1.

FIG. 1 is schematic view of the substrate in accordance with one embodiment. In the embodiment, the substrate 100 includes a plurality of data lines 110, scanning lines 120, and a plurality of pixel cells 130, 140. Each of the pixel cells 130, 140 includes a first sub-pixel 131, 141, and a second sub-pixel 132, 142. The substrate 100 may be driven by row-two-dot-inversion. That is, for the pixel cells in each of the rows of the data lines 110, the polarities of the driving voltage of the adjacent pixel cell set are different.

Specifically, one column pixel cell 130 and one column pixel cell 140, which are located adjacently to each other as shown in FIG. 1, constitute a pixel cell set 150. Each of the scanning lines 120 connects with one pixel cell set 150 for providing voltage signals to the pixel cell set 150.

Regarding the pixel cells located in each of the rows, the first sub-pixel 131 of the first pixel cell 130 of the column set of pixel cell 150 connects with two scanning lines 120. The second sub-pixel 132 of the first pixel cell 130 connects with one of the two scanning lines 120. The first sub-pixel 141 of the second pixel cell 140 of the pixel cell set 150 connects with one of the scanning lines 120 connected with the first pixel cell 130 in the same row, and connects with one of the scanning lines 120 connected with the first pixel cell 130 in the adjacent next row. The first portion 142 of the second pixel cell 140 connects to one scanning lines 120 connected with the first sub-pixel 141 of the second pixel cell 140. With respect to the pixel cells in the last row, the first sub-pixel 141 of the second pixel cell 140 connects to one scanning lines 120 connected with the first pixel cell 130 in the same row, and connects to one scanning line 120 being independently arranged, as shown in FIG. 1. Alternatively, the first sub-pixel 141 of the second pixel cell 140 connects to one of the scanning line 120 connected with the first pixel cell 130, and connects to one of the scanning lines 120 connected with the first pixel cell 130 in the first row.

As shown in FIG. 1, the first pixel cell 130 in each row connects to two scanning lines 120 having a first scanning line 120*a* and a second scanning line 120*b*. The first scanning line 120*a* and the second scanning line 120*b* are arranged at two lateral sides of the first pixel cell 130. The second sub-pixel 132 of the first pixel cell 130 connects with the first scanning line 120*a* connected with the first sub-pixel 131 of the first pixel cell 130. The first sub-pixel 141 of the second pixel cell 140 connects to the second scanning line 120*b* connected with the first pixel cell 130 in the same row, and connects to the first scanning line 120*a* connected with the first pixel cell 130 in the adjacent next row. The second sub-pixel 142 of the second pixel cell 140 connects to the second scanning line 120*b* connected with the first pixel cell 130 in the same row.

Within the above substrate, the scanning lines 120 outputs turn-on signals to connect the sub-pixels connected with the scanning lines 120 and the corresponding data lines 110. For instance, the pixel cells connect with the data lines or the scanning lines via thin-film transistors (TFT). The first sub-pixels 131, 141 of the pixel cells 130, 140 connect with the data lines 110 via two transistors. Control end of the two TFTs connect with the two corresponding scanning lines 120 of the first sub-pixels 131, 141 such that the two TFTs are controlled to turn on or off by the two corresponding scanning lines 120 of the first sub-pixels 131, 141. The second sub-pixels 132, 142 of the pixel cells connect with the data lines 110 via one TFT. The control end of the TFT connects with the corresponding scanning lines 120 of the second sub-pixels 132, 142. The TFTs may be controlled to be turned off by the corresponding scanning lines 120 of the second sub-pixels 132, 142. The scanning signals of the scanning lines may be generated by gate driver on array (GOA).

When driving the first pixel cells 130, 140, the durations of the turn-on signals outputted by the two scanning lines 120*a*, 120*b* are different, or the turn-on signals are asynchronous. As such, a turn-on period of the second sub-pixel of the pixel cell connecting with the data line is longer than the turn-on period of the first sub-pixel connecting with the corresponding data line.

Figure 3:
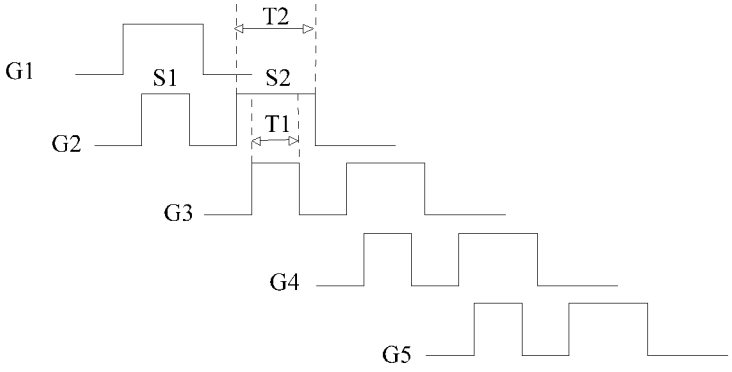
FIG. 3 is a first schematic view of the scanning signals of a portion of the scanning lines of FIG. 1.
Figure 5:
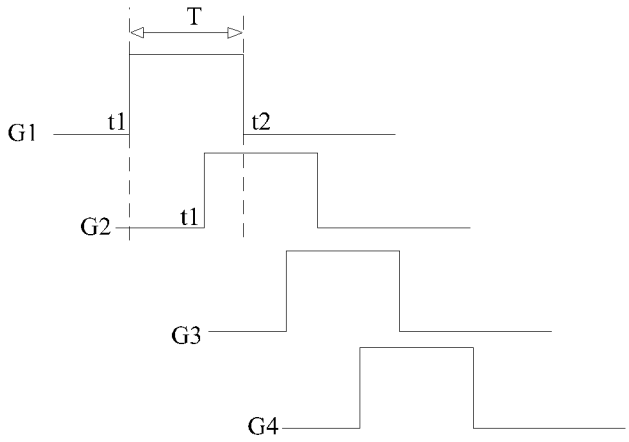
FIG. 5 is a second schematic view of the scanning signals of a portion of the scanning lines of FIG. 1.

For instance, as shown in FIG. 3, each of the scanning lines inputs scanning signals (G) according to time sequence. It can be understood that only the scanning lines (G1, G2, G3, G4, G5) of a portion of scanning lines in FIG. 1 are shown in FIGS. 3 and 5. The scanning signals of the scanning lines that are not shown are basically the same with that of the above-mentioned scanning lines. The difference only resides in that the start time of the turn-on signals are different. As shown in FIG. 3, the scanning signals of each of the scanning lines include the turn-on signals, which is the high level signals, such as 3V or 5V, of the scanning signals. In addition, the turn-on signals of the scanning lines 120 include a first turn-on signals S1 and a second turn-on signals S2. A duration (T1) of the first turn-on signals S1 is shorter than the duration (T2) of the second turn-on signals S2. In addition, the start time of the first turn-on signals S1 is, at least, within the duration of the second turn-on signals S2 of the scanning line of a previous row.

Figure 4:
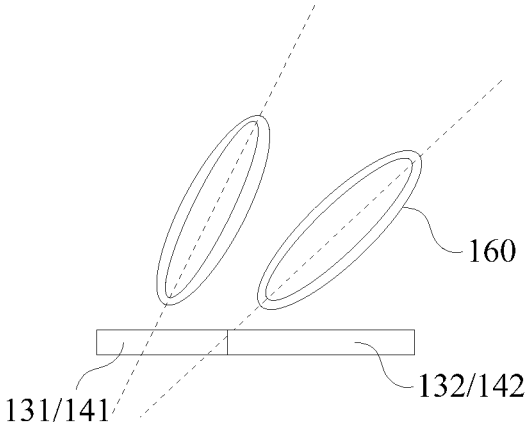
FIG. 4 is a schematic view showing the twisted liquid crystals driven by the first and the second sub-pixels of the substrate of FIG. 1.

Referring to FIGS. 1 and 3, the driving principle of the substrate will be described hereinafter. When the scanning line inputs the second turn-on signals S2, the data line outputs the driving voltage of the pixel cell, wherein the second sub-pixel connected with the scanning line. For instance, when the scanning line corresponding to the G1 inputs second turn-on signals S2, the data line corresponding to the first pixel cell 130 of the first row in FIG. 1 provides the driving voltage. The second sub-pixel 132 of the first pixel cell 130 located in the first row obtains a voltage inputted by the corresponding data line so as to charge. When the corresponding scanning line of G2 inputs first turn-on signals S1, the first sub-pixel 131 of the first pixel cell 130 located in the first row obtains a voltage inputted by the corresponding data line so as to charge. As the first sub-pixel 131 and the second sub-pixel 132 of the first pixel cell 130 are charged at different time, and thus the voltage of the first sub-pixel 131 and the second sub-pixel 132 are different. Further, the alignment of the liquid crystals 160 may are different, as shown in FIG. 4, and thus the color shift is reduced.

For instance, as shown in FIG. 5, each of the scanning line inputs the scanning signals (G) according to time sequence. The scanning signals of each of the scanning lines include the turn-on signals, which is the high level signals, such as 3V or 5V, of the scanning signals. In addition, the turn-on signals of the scanning lines 120 include a first turn-on signals S1 and a second turn-on signals S2. The duration of the turn-on signals of each of the scanning lines 120 are the same, which is T. In addition, the start time (t1) of the turn-on signals of the previous row is earlier than the start time (t1) of the turn-on signals of the next row. In addition, the end time (t2) of the turn-on signals of the previous row is later than the start time (t1) of the turn-on signals of the next row.

The driving principle is similar to that of FIG. 3. The process of driving the substrate of FIG. 1 by the scanning signals of FIG. 5 will be described hereinafter. When the scanning line inputs the turn-on signals, the data line outputs the driving voltage of the pixel cell, wherein the second sub-pixel connected with the scanning line. For instance, when the scanning line corresponding to the G1 inputs the turn-on signals, the data line corresponding to the first pixel cell 130 of the first row in FIG. 1 provides the driving voltage. The second sub-pixel 132 of the first pixel cell 130 located in the first row obtains a voltage inputted by the corresponding data line so as to charge. During the duration where G1 inputs the signals, the scanning line corresponding to the G2 starts to input the turn-on signals. The first sub-pixel 131 of the first pixel cell 130 located in the first row also obtains a voltage inputted by the corresponding data line so as to charge. As the first sub-pixel 131 and the second sub-pixel 132 of the first pixel cell 130 are charged at different time, and thus the voltage of the first sub-pixel 131 and the second sub-pixel 132 are different. Further, the alignment of the liquid crystals 160 may are different, as shown in FIG. 4, and thus the color shift is reduced.

It can be understood that two scanning signals, as shown in FIGS. 3 and 5, are described with respect to the substrate of FIG. 1. Nevertheless, the above substrate may be driven by scanning signals other than the above two. That is, the scanning signals may be configured differently in accordance with the structure of the substrate. The principle is that the durations of the turn-on signals outputted by the two scanning lines are different, or the turn-on signals are asynchronous. As such, the turn-on period of the second sub-pixel of the pixel cell connecting with the data line is longer than that of the first sub-pixel.

In addition, in other embodiments, the first and the second sub-pixel of each of the pixel cell sets may be configured accordingly. For instance, the pixel cell set may be configured according to the pre-charge condition of the second sub-pixel of the second pixel cell. That is, when one of the pixel cell of the pixel cell set is driven, the second sub-pixel of the other pixel cell connects with the data line for the reason that the second sub-pixel of the other pixel cell connects with one of the scanning line of the pixel cell. For instance, as shown in FIG. 1, the first pixel cell may be the pixel cell located in the odd column, and the second pixel cell may be the pixel cell located in the even column. In other embodiments, the first pixel cell may be the pixel cell located in the even column, and the second pixel cell may be the pixel cell located in the odd column.

It can be understood that the first pixel cell and the second pixel cell of each of the rows may be configured in different column. Two examples will be described hereinafter.

Figure 6:
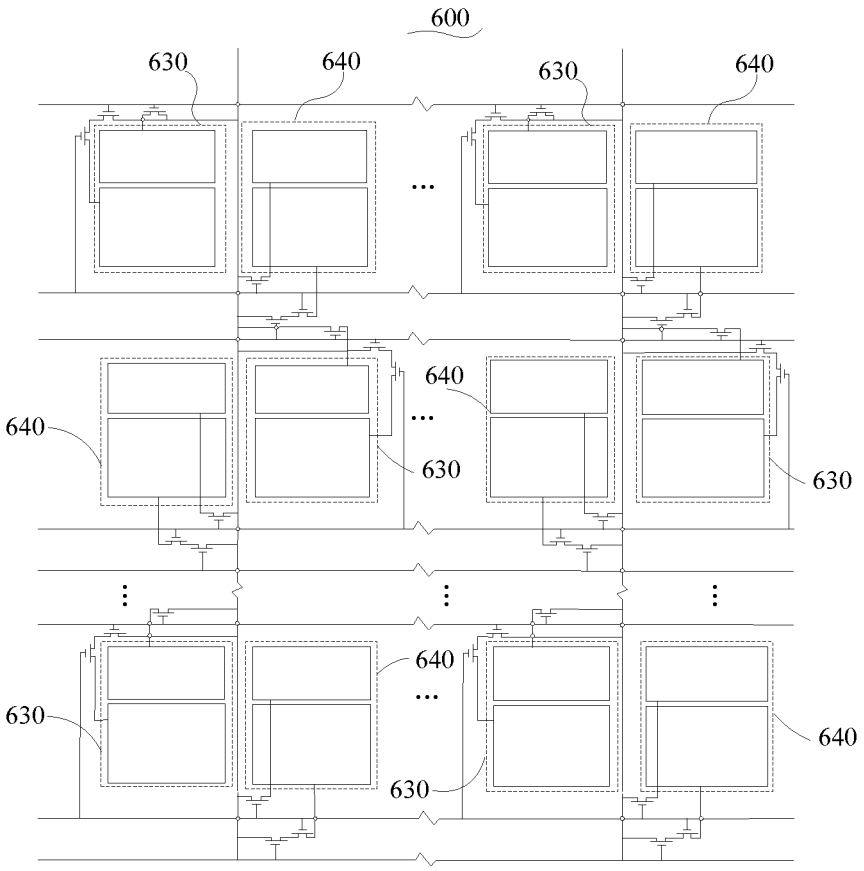
FIG. 6 is a schematic view of the substrate in accordance with another embodiment.

FIG. 6 is a schematic view of the substrate in accordance with another embodiment. In the embodiment, the first pixel cell 630 of the substrate 600 includes the pixel cell in the odd row and in the odd column and the pixel cell in the even row and in the even column. The second pixel cell 640 of the substrate 600 includes the pixel cell in the odd row and in the even column and the pixel cell in the even row and in the odd column. In other embodiments, the second pixel cell of the substrate includes the pixel cell in the odd row and in the odd column and the pixel cell in the even row and in the even column, and the first pixel cell includes the pixel cell in the even row and in the odd column and the pixel cell in the odd row and in the even column.

Figure 7:
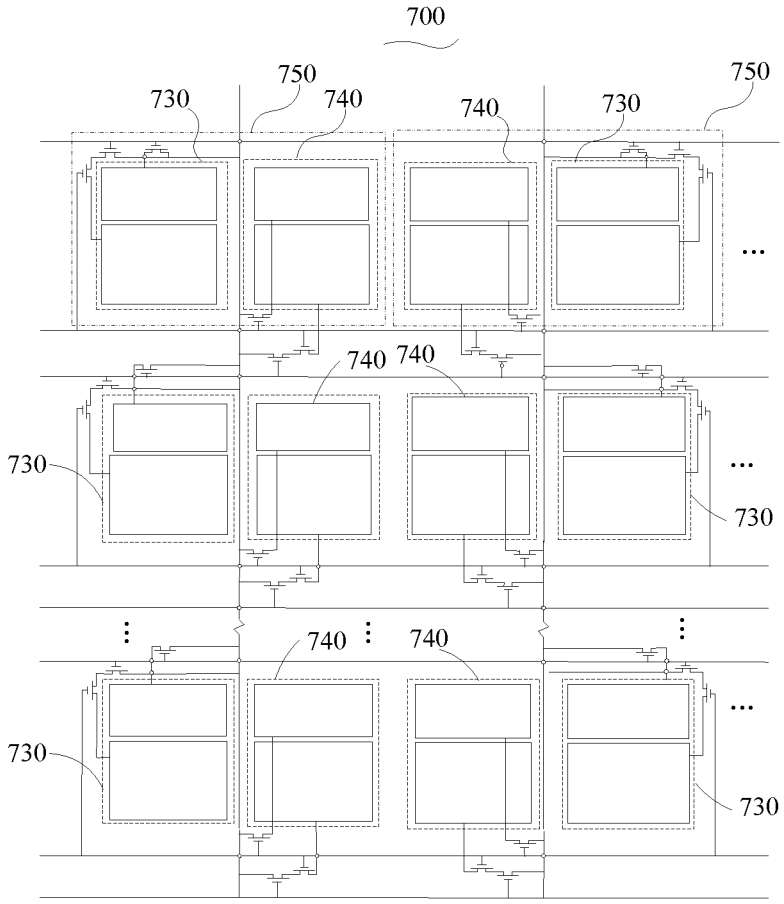
FIG. 7 is a schematic view of the substrate in accordance with another embodiment.

FIG. 7 is a schematic view of the substrate in accordance with another embodiment. The substrate 700 includes a first pixel cell 730 and a second pixel cell 740. The first pixel cell 730 includes the two adjacent pixel cells of the pixel cell set 750 located in odd and even column. The second pixel cell 740 includes the other two adjacent pixel cells of the pixel cell set 750 located in odd and even column. For instance, as shown in FIG. 7, four pixel cell columns constitute two adjacent pixel cell sets 750. The first pixel cell 730 includes the pixel cells of the first pixel cell set 750 located in the odd column and the pixel cell of the second pixel cell set 750 located in the even column. The second pixel cell 740 includes the pixel cells of the pixel cell set 750 located in the even column and the pixel cell of the pixel cell set 750 located in the odd column.

In the above embodiments, the three adjacent pixel cells in the same row are respectively red, green, and blue pixel cells.

In the above embodiments, the first and the second scanning line are respectively arranged at two lateral sides of the first sub-pixel. In other embodiments, the first scanning line and the second scanning line are arranged at the same side of the first sub-pixel. For instance, the first scanning line and the second scanning line are arranged at an upper side or a down side of the first sub-pixel, and the first and the second scanning lines are spaced apart from each other.

According to the present disclosure, a liquid crystal display includes a first substrate, a second substrate opposite to the first substrate, and liquid crystals between the first and the second substrate. The first substrate may be the above substrate.

The first substrate charges the first and the second sub-pixel of the pixel cells of the first substrate according to the signals of the corresponding scanning lines and the data lines. After being charged, the first and the second sub-pixels forms the electrical fields having different levels with the second substrate so as to drive the liquid crystals in the areas corresponding to the first and the second sub-pixels to twist. In this way, the color shift may be reduced.

In an example, the LCD may be one VA LCDs.

In view of the above, the pixel cell of the substrate includes a first sub-pixel and a second sub-pixel. The first sub-pixel connects to two scanning lines, and the second sub-pixel connects to one of the scanning lines connected with the first sub-pixel. When the pixel cells are driven, the durations of the turn-on signals of the second sub-pixel with respect to the corresponding data line is longer than that of the first sub-pixel. As such, the turn-on period of the second sub-pixel of the pixel cell corresponding to the data line is longer than that of the first sub-pixel. That is, the charging duration of the first sub-pixel is different from that of the second sub-pixel, which results in that different voltages are adopted to drive the liquid crystals corresponding to the first and the second sub-pixel. In this way, the alignment of the liquid crystals are different so as to reduce the color shift. In addition, every two pixel cells located in adjacent columns may share one data line, which reduces the number of the data lines so as to guarantee the aperture rate and the cost.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A substrate, comprising: a plurality of data lines, scanning lines, pixel cells arranged in a matrix, each of the pixel cells comprising a first sub pixel and a second sub pixel, wherein the pixel cells located in every two adjacent columns constituting a pixel cell set, each pixel cell set comprising a first pixel cell and a second pixel cell which are both located in a same row; the first pixel cell and the second pixel cell each comprising a first sub-pixel and a second sub-pixel, each of the data lines connecting to one pixel cell set for providing voltage signals to the pixel cell set; the first pixel cell and the second pixel cell of each pixel cell set are connected to a same data line;

for the pixel cells in each row, the first sub-pixel of the first pixel cell of the pixel cell set connecting with the two scanning lines comprising a first scanning line and a second scanning line, the first scanning line and the second scanning line being arranged at two lateral and opposite sides of the first sub-pixel, the second sub-pixel of the first pixel cell connecting with the first scanning line connected with the first sub-pixel of the first pixel cell; the first sub-pixel of the second pixel cell of the pixel cell set connecting with the second scanning line connected with the first pixel cell located in the same row, connecting with the first scanning line connected with the first pixel cell in the adjacent next row, and the second sub-pixel of the second pixel cell connecting with the second scanning line connected with the first pixel cell in the same row; the scanning line outputting turn-on signals for connecting the sub-pixels connected with the scanning line to the corresponding data line; when the pixel cells being driven, durations of the turn-on signals outputted by the two scanning lines connected with the pixel cell being different or the turn-on signals being asynchronous such that a turn-on period of the second sub-pixel of the pixel cell connecting with the data line being longer than the turn-on period of the first sub-pixel connecting with the corresponding data line; and the second sub-pixel connecting to the corresponding data line via a transistor, a control end of the transistor connecting with the scanning line corresponding to the second sub-pixel, the first sub-pixel connecting with the corresponding data line via two transistors, the control ends of the two transistors respectively connecting with the two scanning lines corresponding to the first sub-pixel wherein the second scanning line connecting with the first pixel cell in a present row is separated from the first scanning line connecting with the first pixel cell in a next row adjacent to the present row; both the second scanning line connecting with the first pixel cell in the present row and the first scanning line connecting with the first pixel cell in the next row are located at the same side of the first pixel cell in the next row and between the first pixel cell in the present row and the first pixel cell in the next row.

2. The substrate as claimed in claim 1, wherein the first pixel cell is the pixel cell in the odd column, and the second pixel cell is the pixel cell in the even column; or the second pixel cell is the pixel cell in the odd column, and the first pixel cell is the pixel cell in the even column.

3. The substrate as claimed in claim 1, wherein the first pixel cell comprises the pixel cell in the odd row and in the odd column and the pixel cell in the even row and in the even column, and the second pixel cell comprises the pixel cell in the odd row and in the even column and the pixel cell in the even row and in the odd column; or the second pixel cell comprises the pixel cell in the odd row and in the odd column and the pixel cell in the even row and in the even column, and the first pixel cell comprises the pixel cell in the odd row and in the even column and the pixel cell in the even row and in the odd column.

4. The substrate as claimed in claim 1, wherein the first pixel cell comprises the pixel cells located in one odd column and one even column of the two adjacent pixel cell set, and the second pixel cell comprises the pixel cells located in the other odd column and the other even column of the two adjacent pixel cell set.

5. The substrate as claimed in claim 1, wherein the turn-on signals of the scanning lines comprises a first turn-on signals and a second turn-on signals, a duration of the first turn-on signals is shorter than the duration of the second turn-on signals, and a start time of the first turn-on signals is at least within the duration of the second turn-on signals of the scanning line of a previous row.

6. A substrate, comprising: a plurality of data lines, scanning lines, pixel cells arranged in a matrix, each of the pixel cells comprising a first sub pixel and a second sub pixel, wherein the pixel cells located in every two adjacent columns constituting a pixel cell set, each pixel cell set comprising a first pixel cell and a second pixel cell which are both located in a same row; the first pixel cell and the second pixel cell each comprising a first sub-pixel and a second sub-pixel, each of the data lines connecting to one pixel cell set for providing voltage signals to the pixel cell set; the first pixel cell and the second pixel cell of each pixel cell set are connected to a same data line; for the pixel cells in each row, the first sub-pixel of the first pixel cell of the pixel cell set connects with the two scanning lines wherein the two scanning lines comprising a first scanning line and a second scanning line, the first scanning line and the second scanning line being arranged at two lateral and opposite sides of the first sub-pixel, the second sub-pixel of the first pixel cell connecting with one of the scanning lines; the first sub-pixel of the second pixel cell of the pixel cell set connecting with one of the scanning lines connected with the first pixel cell in the same row, and connecting with one scanning line connected with the first pixel cell in the adjacent next row, and the second sub-pixel of the second pixel cell connecting with one of the scanning lines connected with the first sub-pixel of the second pixel cell; the scanning line outputting turn-on signals for connecting the sub-pixels connected with the scanning line to the corresponding data line; and when the pixel cells being driven, durations of the turn-on signals outputted by the two scanning lines connected with the pixel cell being different or the turn-on signals being asynchronous such that a turn-on period of the second sub-pixel of the pixel cell connecting with the data line being longer than the turn-on period of the first sub-pixel connecting with the corresponding data line; the second scanning line connecting with the first pixel cell in a present row is separated from the first scanning line connecting with the first pixel cell in a next row adjacent to and next to the present row; both the second scanning line connecting with the first pixel cell in the present row and the first scanning line connecting with the first pixel cell in the next row are located at the same side of the first pixel cell in the next row and between the first pixel cell in the present row and the first pixel cell in the next row.

7. The substrate as claimed in claim 6, wherein the first pixel cell is the pixel cell in the odd column, and the second pixel cell is the pixel cell in the even column; or the second pixel cell is the pixel cell in the odd column, and the first pixel cell is the pixel cell in the even column.

8. The substrate as claimed in claim 6, wherein the first pixel cell comprises the pixel cell in the odd row and in the odd column and the pixel cell in the even row and in the even column, and the second pixel cell comprises the pixel cell in the odd row and in the even column and the pixel cell in the even row and in the odd column; or the second pixel cell comprises the pixel cell in the odd row and in the odd column and the pixel cell in the even row and in the even column, and the first pixel cell comprises the pixel cell in the odd row and in the even column and the pixel cell in the even row and in the odd column.

9. The substrate as claimed in claim 6, wherein the first pixel cell comprises the pixel cells located in one odd column and one even column of the two adjacent pixel cell sets, and the second pixel cell comprises the pixel cells located in the other odd column and the other even column of the two adjacent pixel cell sets.

10. The substrate as claimed in claim 6, wherein the second sub-pixel of the first pixel cell connects with the first scanning line connected with the first sub-pixel of the first pixel cell; and the first sub-pixel of the second pixel cell connects to the second scanning line connected with the first pixel cell in the same row, and connects to the first scanning line connected with the first pixel cell in the adjacent next row, and the second sub-pixel of the second pixel cell connects to the second scanning line connected with the first pixel cell in the same row.

11. The substrate as claimed in claim 10, wherein the turn-on signals of the scanning lines comprises a first turn-on signals and a second turn-on signals, a duration of the first turn-on signals is shorter than the duration of the second turn-on signals, and a start time of the first turn-on signals is at least within the duration of the second turn-on signals of the scanning line of a previous row.

12. The substrate as claimed in claim 6, wherein the three adjacent pixel cells in the same row are respectively red, green, and blue pixel cells.

13. The substrate as claimed in claim 6, wherein the second sub-pixel connects to the corresponding data line via a transistor, a control end of the transistor connects with the scanning line corresponding to the second sub-pixel, the first sub-pixel connects with the corresponding data line via two transistors, the control ends of the two transistors respectively connects with the two scanning lines corresponding to the first sub-pixel.

14. The substrate as claimed in claim 6, wherein polarities of driving voltages of the first pixel cell and the second pixel cell in the same pixel cell set are the same, and polarities of driving voltages of two adjacent pixel cell sets in each row are different from each other.

15. A LCD, comprising: a first substrate and a second substrate opposite to the first substrate, and liquid crystals between the first and the second substrate, the first substrate comprising: a plurality of data lines, scanning lines, pixel cells arranged in a matrix, each of the pixel cells comprising a first sub pixel and a second sub pixel, wherein the pixel cells located in every two adjacent columns constituting a pixel cell set, each pixel cell set comprising a first pixel cell and a second pixel cell which are both located in a same row; the first pixel cell and the second pixel cell each comprising a first sub-pixel and a second sub-pixel, each of the data lines connecting to one pixel cell set for providing voltage signals to the pixel cell set; the first pixel cell and the second pixel cell of each pixel cell set are connected to a same data line; for the pixel cells in each row, the first sub-pixel of the first pixel cell of the pixel cell set connects with the two scanning lines, wherein the two scanning lines comprising a first scanning line and a second scanning line, the first scanning line and the second scanning line being arranged at two lateral and opposite sides of the first sub-pixel, the second sub-pixel of the first pixel cell connecting with one of the scanning lines; the first sub-pixel of the second pixel cell of the pixel cell set connecting with one of the scanning lines connected with the first pixel cell in the same row, and connecting with one scanning line connected with the first pixel cell in the adjacent next row, and the second sub-pixel of the second pixel cell connecting with one of the scanning lines connected with the first sub-pixel of the second pixel cell; the scanning line outputting turn-on signals for connecting the sub-pixels connected with the scanning line to the corresponding data line; and when the pixel cells being driven, durations of the turn-on signals outputted by the two scanning lines connected with the pixel cell being different or the turn-on signals being asynchronous such that a turn-on period of the second sub-pixel of the pixel cell connecting with the data line being longer than the turn-on period of the first sub-pixel connecting with the corresponding data line; the second scanning line connecting with the first pixel cell in a present row is separated from the first scanning line connecting with the first pixel cell in a next row adjacent to and next to the present row; both the second scanning line connecting with the first pixel cell in the present row and the first scanning line connecting with the first pixel cell in the next row are located at the same side of the first pixel cell in the next row and between the first pixel cell in the present row and the first pixel cell in the next row.

16. The LCD as claimed in claim 15, wherein the first pixel cell is the pixel cell in the odd column, and the second pixel cell is the pixel cell in the even column; or the second pixel cell is the pixel cell in the odd column, and the first pixel cell is the pixel cell in the even column.

17. The LCD as claimed in claim 15, wherein the first pixel cell comprises the pixel cell in the odd row and in the odd column and the pixel cell in the even row and in the even column, and the second pixel cell comprises the pixel cell in the odd row and in the even column and the pixel cell in the even row and in the odd column; or the second pixel cell comprises the pixel cell in the odd row and in the odd column and the pixel cell in the even row and in the even column, and the first pixel cell comprises the pixel cell in the odd row and in the even column and the pixel cell in the even row and in the odd column.

18. The LCD as claimed in claim 15, wherein the first pixel cell comprises the pixel cells located in one odd column and one even column of the two adjacent pixel cell sets, and the second pixel cell comprises the pixel cells located in the other odd column and the other even column of the two adjacent pixel cell sets.

19. The LCD as claimed in claim 15, wherein the second sub-pixel of the first pixel cell connects with the first scanning line connected with the first sub-pixel of the first pixel cell; and the first sub-pixel of the second pixel cell connects to the second scanning line connected with the first pixel cell in the same row, and connects to the first scanning line connected with the first pixel cell in the adjacent next row, and the second sub-pixel of the second pixel cell connects to the second scanning line connected with the first pixel cell in the same row.

* * * * *